US009082372B2

(12) United States Patent
Suzuki

(10) Patent No.: US 9,082,372 B2
(45) Date of Patent: Jul. 14, 2015

(54) KEYBOARD DEVICE FOR KEYBOARD INSTRUMENT

(71) Applicant: KABUSHIKI KAISHA KAWAI GAKKI SEISAKUSHO, Hamamatsu-shi, Shizuoka-ken (JP)

(72) Inventor: Akihiro Suzuki, Hamamatsu (JP)

(73) Assignee: KABUSHIKI KAISHA KAWAI GAKKI SEISAKUSHO, Hamamatsu-shi (JP)

( * ) Notice: Subject to any disclaimer, the term of this patent is extended or adjusted under 35 U.S.C. 154(b) by 0 days.

(21) Appl. No.: 14/480,442

(22) Filed: Sep. 8, 2014

(65) Prior Publication Data

US 2015/0082969 A1 Mar. 26, 2015

(30) Foreign Application Priority Data

Sep. 26, 2013 (JP) ..... 2013-199720

(51) Int. Cl.
*G10C 3/12* (2006.01)

(52) U.S. Cl.
CPC ..... *G10C 3/12* (2013.01)

(58) Field of Classification Search
CPC ..... G10C 3/12
See application file for complete search history.

(56) References Cited

U.S. PATENT DOCUMENTS

| | | | | |
|---|---|---|---|---|
| 5,542,332 | A * | 8/1996 | Tamai et al. | 84/435 |
| 7,208,668 | B2 * | 4/2007 | Shimoda | 84/434 |
| 8,110,732 | B2 * | 2/2012 | Shimoda | 84/423 R |
| 8,969,698 | B1 * | 3/2015 | Suzuki | 84/436 |

FOREIGN PATENT DOCUMENTS

| | | |
|---|---|---|
| JP | 2003-330450 | 11/2003 |
| JP | 2011-027854 | 2/2011 |

* cited by examiner

*Primary Examiner* — Robert W Horn
(74) *Attorney, Agent, or Firm* — Christie, Parker & Hale, LLP

(57) ABSTRACT

A keyboard device for a keyboard instrument capable of having each key easily mounted on a keyboard chassis while ensuring stable pivotal motion of the key, without damaging the key. A keyboard chassis holds keys in arrangement in a left-right direction. A key support part has a lower support portion for supporting a pivot shaft of a key from below, and left and right upper support portions erected with a predetermined spacing in the direction, for supporting a key rear end portion located upward of the shaft from above. When mounting the key to the key support part, the upper support portions have its spacing expanded by the key rear end, thereby being elastically deformed to pass the key rear end, and thereafter, elastically return to their original state to hold the key rear end in a retained state by cooperating with the lower support portion.

2 Claims, 6 Drawing Sheets

KEYBOARD DEVICE FOR KEYBOARD INSTRUMENT

CROSS-REFERENCE TO RELATED APPLICATION(S)

This application claims priority to and the benefit of Japanese Patent Application No. 199720/2013, filed on Sep. 26, 2013, the disclosure of which is hereby incorporated by reference in its entirety.

BACKGROUND OF THE INVENTION

1. Field of the Invention

The present invention relates to a keyboard device applied to a keyboard instrument, such as an electronic piano, and more particularly to a key support structure for pivotally supporting keys.

2. Description of the Related Art

Conventionally, there have been known, for example, keyboard devices disclosed in Japanese Laid-Open Patent Publications (Kokai) No. 2011-27854 and No. 2003-330450 filed by the present applicant. Each of the keyboard devices disclosed in Japanese Laid-Open Patent Publications (Kokai) No. 2011-27854 and No. 2003-330450 has a keyboard chassis and a plurality of keys including white keys and black keys. The keys each extend in a front-rear direction and are arranged in a left-right direction, with respective rear ends thereof pivotally supported on the keyboard chassis. Further, in each of the keyboard devices, the keyboard chassis and each of the keys are formed by injection-molding of predetermined synthetic resins, respectively. More specifically, an ABS resin is used for the keyboard chassis, and an AS resin which has a higher hardness than that of the ABS resin is used for the keys so as to prevent the keys from being easily scratched.

In the keyboard device disclosed in Japanese Laid-Open Patent Publication (Kokai) No. 2011-27854, each key and the keyboard chassis are constructed as follows: The key has pivot shafts projecting outward from respective left and right sides of the rear end thereof. On the other hand, the keyboard chassis has a first support part which is arc-shaped for supporting the pivot shafts of the key. A pivot shaft bearing member having a second support part that cooperates with the first support part to constitute a bearing for the pivot shafts is removably mounted on the keyboard chassis with screws. According to the keyboard device constructed as above, it is possible to improve the ease of assembly during a manufacturing operation and disassembly during an operation for disposal, while ensuring stable pivotal motion of the keys.

On the other hand, in the keyboard device disposed in Japanese Laid-Open Patent Publication (Kokai) No. 2003-330450, each key and the keyboard chassis are constructed as follows: The key has a top wall, which has a rear end cut out into a U shape, and left and right side walls, which have respective rear ends formed to largely protrude downward and have respective inner surfaces formed with protrusions opposed to each other. On the other hand, the keyboard chassis has a keyboard support part provided thereon on a key-by-key basis for supporting each key. The keyboard support part is formed therethrough with an engagement hole that extends in the left-right direction, for being engaged with the two protrusions of the rear ends of the side walls of the key, in their state inserted from the opposite sides of the keyboard support part. When mounting the key on the keyboard chassis, the rear end of the key is pressed toward the associated one of the keyboard support parts of the keyboard chassis, whereby the rear end of the key is elastically deformed such that the left and right side walls of the key are pushed laterally outward to increase spacing therebetween. Then, when the key is further pressed downward, the two protrusions are snap-fitted into the engagement hole of the keyboard support part through elastic return of the opposite side walls of the rear end of the key to their original state. According to the keyboard device constructed as above, it is possible to achieve reduction of manufacturing costs by reducing the number of component parts and that of assembly steps, while ensuring stable pivotal motion of the keys.

However, in the case of the keyboard device disclosed in Japanese Laid-Open Patent Publication (Kokai) No. 2011-27854, it is required to attach the pivot shaft bearing member as a separate component part to the keyboard chassis, for supporting the associated key, and fix the same with screws, which causes an increase in the number of component parts and that of assembly steps. Further, if the pivot shaft bearing member is mounted on the keyboard chassis with a mounting error, the pivot shafts of the key are loosened, which is liable to generate noise during key depression. On the other hand, the keyboard device disclosed in Japanese Laid-Open Patent Publication (Kokai) No. 2003-330450 makes it possible to reduce the number of component parts and that of assembly steps in comparison with the keyboard device disclosed in Japanese Laid-Open Patent Publication (Kokai) No. 2011-27854, but since the key is made of the AS resin having a hard property because of the requirement of properties thereof as mentioned hereinabove, there is a fear that when attaching or removing the key to or from the keyboard chassis, if the left and right side walls of the rear end of the key are forcibly pushed laterally outward overcoming much difficulty in order to increase spacing therebetween, the side walls suffer damage, such as cracking. Further, there is a fear that when the keyboard is pushed forward due to an impact e.g. during transit, the side walls of the key are deformed in a direction of moving apart from each other, whereby the protrusions of the rear end are disengaged from the engagement hole of the keyboard support part.

SUMMARY OF THE INVENTION

The present invention provides a keyboard device for a keyboard instrument, in which it is possible to easily mount each key on a keyboard chassis while ensuring stable pivotal motion of the key, without damaging the key during the mounting operation.

The present invention provide a keyboard device for a keyboard instrument, comprising a plurality of keys each extending in a front-rear direction and having a pivot shaft extending from a rear end of the key in a left-right direction, and a keyboard chassis having a plurality of key support parts for supporting the keys, respectively, such that each of the keys can pivotally move about an associated one of the pivot shafts, and configured to hold the keys in a state arranged in the left-right direction, wherein each of the key support parts includes a lower support portion for supporting the pivot shaft of an associated one of the keys from below, and a pair of left and right upper support portions erected with a predetermined spacing therebetween in the left-right direction, and configured to support a portion of the rear end of the key located upward of the pivot shaft from above, and wherein when mounting the key to the key support part, spacing between the pair of upper support portions is expanded by the rear end of the key, whereby the pair of upper support portions are elastically deformed to thereby allow the rear end of the key to pass therebetween, and after the rear end of the key has passed, the pair of upper support portions elastically return to an original state thereof and cooperate with the lower support portion to hold the rear end of the key in a retained state.

With the construction of this keyboard device for a keyboard instrument, each of the keys each extending in the front-rear direction has the pivot shaft extending in the left-right direction, formed at the rear end of the key, and the keys are held on the keyboard chassis in a state arranged in the left-right direction and are supported by the respective key support parts such that each of the keys can pivotally move about an associated one of the pivot shafts. Each of the key support parts supports the pivot shaft of the associated the key from below by its lower support portion, and supports the portion of the rear end of the key located upward of the pivot shaft from above by the erected left and right upper support portions.

When mounting the key to the key support part, the pair of upper support portions are deformed as follows: When the rear end of the key is pressed so as to be inserted between the upper support portions, spacing between the two upper support portions is expanded, whereby the rear end of the key is allowed to pass therebetween. Then, after the rear end of the key has passed, the upper support portions elastically return to their original state and cooperate with the lower support portion to hold the rear end of the key in a retained state. This makes it possible to ensure that the key supported by the key support part performs stable pivotal motion about the pivot shaft of the rear end of the key. Further, even when the keyboard device receives an impact e.g. during transit, it is possible to prevent a problem from occurring in which the rear end of the key is disengaged from the keyboard chassis.

Further, differently from the prior art disclosed in Japanese Laid-Open Patent Publication (Kokai) No. 2011-27854, in which separate component parts and screwing operation are required to mount each of the keys on the keyboard chassis, it is possible to easily cause the rear end of the key to be supported by the key support part of the keyboard chassis. This makes it possible not only to prevent noise from being generated due to a mounting error of a component part, but also to achieve reduction of the number of component parts and that of assembly steps. Furthermore, when mounting each key, differently from the prior art disclosed in Japanese Laid-Open Patent Publication (Kokai) No. 2003-330450, in which each key is mounted on the keyboard chassis while elastically deforming the rear end thereof, the upper support portions of the key support part of the keyboard chassis are elastically deformed, but the key is not, so that the key cannot be damaged during an operation for mounting the key on the keyboard chassis.

In addition, since the upper support portions of the key support part, which are elastically deformed when mounting the key on the keyboard chassis, are erected with a spacing therebetween in the left-right direction, and support the portion of the key located upward of the pivot shaft from above, it is possible to increase the height of the upper support portions e.g. compared with the case where the pivot shaft is supported from above, to thereby reduce stress generated when the upper support portions are deformed during mounting of the key. This makes it possible to prevent damage to the upper support portions of the keyboard chassis from being caused.

Preferably, each of the pair of upper support portions has a support surface formed to be concavely curved along a concentric circle about the pivot shaft of an associated one of the keys, and the rear end of the key has a sliding surface formed to be convexly curved along a concentric circle about the pivot shaft and be brought into sliding contact with the support surface.

With the construction of this preferred embodiment, in the key support part of the keyboard chassis supporting the key such that the key can pivotally move about the pivot shaft, the lower support portion directly supports the pivot shaft from below, while each of the pair of upper support portions supports the rear end of the key via its support surface in a state held in contact with the sliding surface of the key. The support surface of each of the upper support portions is formed to be concavely curved along a concentric circle about the pivot shaft of an associated one of the keys, while the sliding surface of the rear end of the key is formed to be convexly curved along a concentric circle about the pivot shaft and be brought into sliding contact with the support surface of the upper support portion. Therefore, it is possible to easily ensure that the key performs smooth and stable pivotal motion about the pivot shaft.

The above and other objects, features, and advantages of the present invention will become more apparent from the following detailed description taken in conjunction with the accompanying drawings

BRIEF DESCRIPTION OF THE DRAWINGS

FIGS. 7A and 7B are views useful in explaining a key pivotal motion support structure of the keyboard chassis, in which:

FIG. 7A is a plan view showing respective rear portions of the keyboard chassis and the key; and FIG. 7B is a partial side cross-sectional view showing respective rear portions of the keyboard chassis and the key.

DETAILED DESCRIPTION OF PREFERRED EMBODIMENTS

Figure 1:
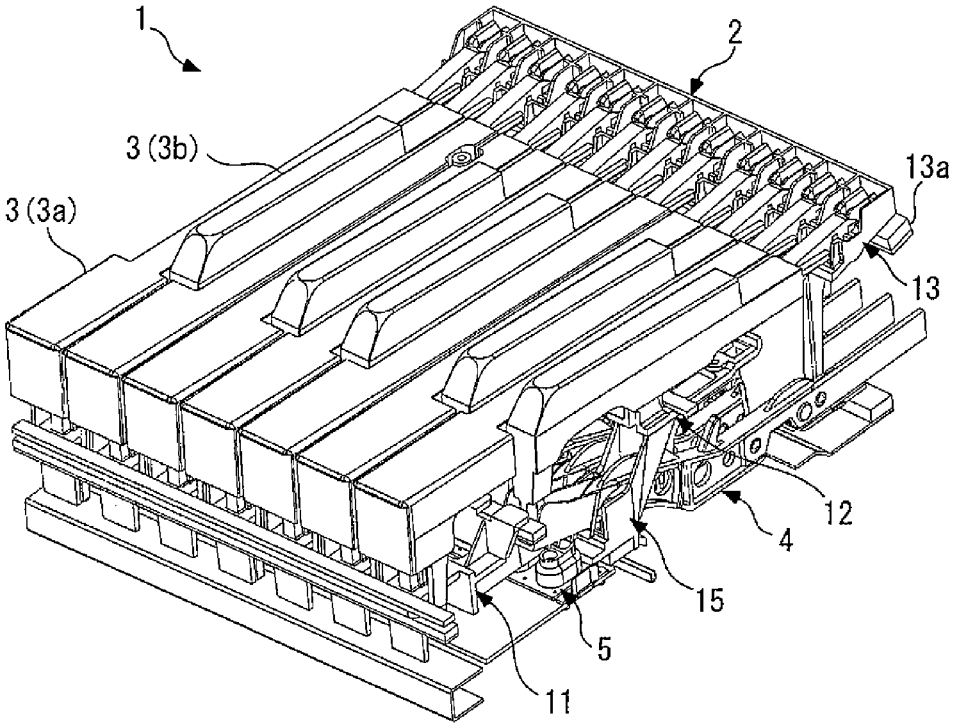
FIG. 1 is a perspective view of a keyboard device (for one octave section) according to an embodiment of the present invention.
Figure 2A:
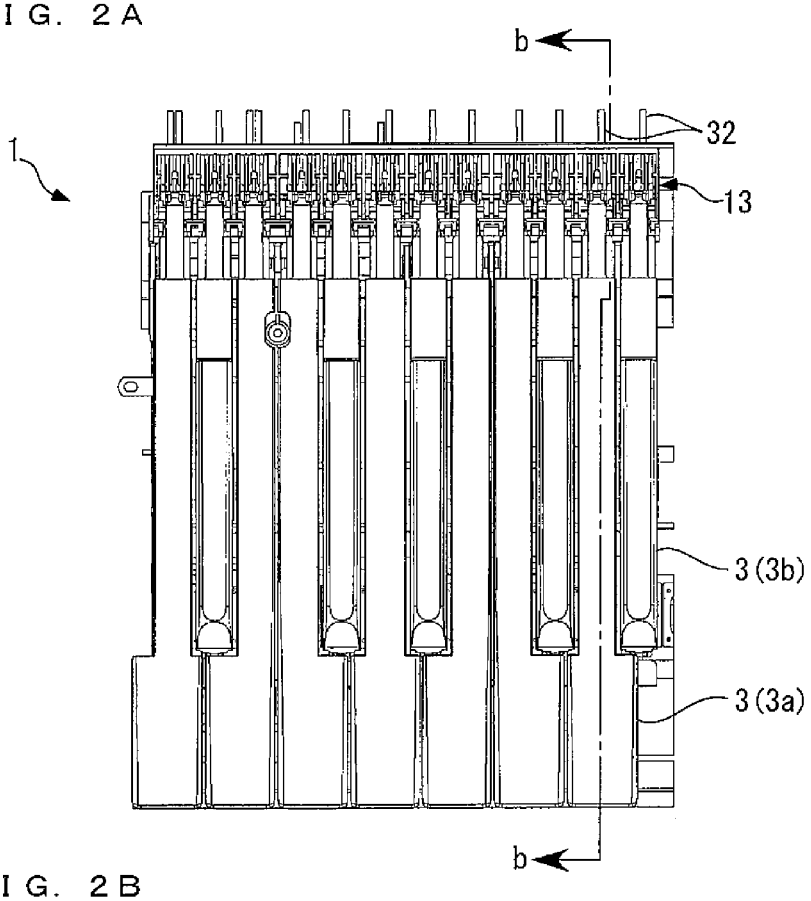
FIG. 2A is a plan view of the keyboard device shown in FIG. 1.
Figure 2B:
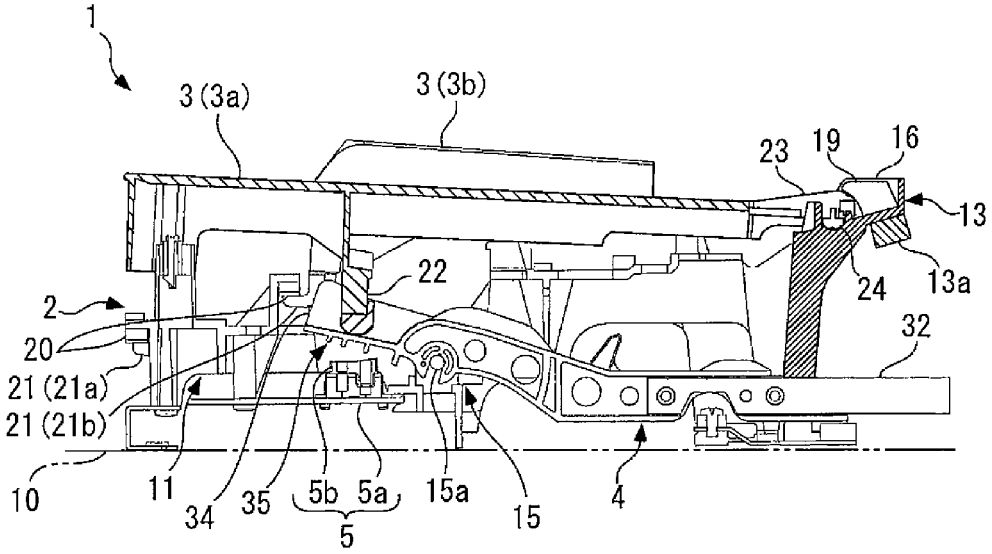
FIG. 2B is a cross-sectional view taken on line b-b of FIG. 2A.

The present invention will now be described in detail with reference to the drawings showing a preferred embodiment thereof. FIGS. 1, 2A, and 2B show a keyboard device of an electronic piano, according to an embodiment of the present invention, which is in a key-released state. Note that FIGS. 1, 2A, and 2B show only a one-octave section of the keyboard device.

As shown in FIGS. 1, 2A, and 2B, the keyboard device 1 is comprised of a keyboard chassis 2, a plurality of keys 3 including white keys 3*a* and black keys 3*b* pivotally mounted on the keyboard chassis 2 and arranged in the left-right direction, a plurality of hammers 4 pivotally mounted on the keyboard chassis 2 in association with the respective keys 3, and a key switch 5 for detecting key depression information on the keys 3.

Figure 3A:
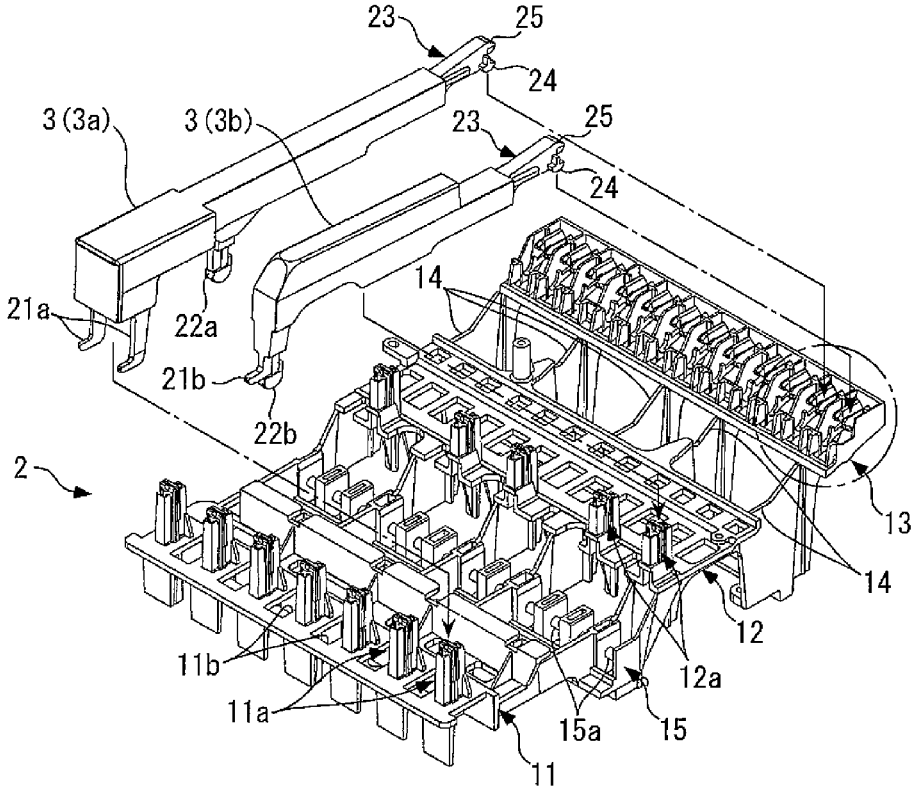
FIG. 3A is an exploded perspective view of a keyboard chassis and keys of the keyboard device in FIG. 1.

The keyboard chassis 2 is formed as a resin molded article which is made by injection molding of a predetermined resin material (e.g. an ABS resin) into a predetermined shape. As shown in FIG. 3A, the keyboard chassis 2 has a front part 11, a central part 12, and a rear part 13 each extending in the left-right direction as a whole. The front part 11, the central part 12, and the rear part 13 are connected to each other by a plurality of ribs 14 disposed with an appropriate spacing therebetween in the left-right direction. Note that in the following description, the front part 11, the central part 12, and the rear part 13 of the keyboard chassis 2 will be referred to as "the chassis front 11", "the chassis center 12", and "the chassis rear 13", respectively.

The chassis front 11 serves to guide the white keys 3*a*. The chassis front 11 has a plurality of white key guide parts 11*a* (only seven of which are shown in FIG. 3A) erected thereon and each inserted into an associated one of the white keys 3*a* from below so as to prevent lateral swing of the white key 3*a*. Further, the chassis front 11 has engagement holes 11*b* and 11*b*, vertically extending therethrough, formed on respective left and right sides of each of the white key guide parts 11*a*. A pair of left and right upper limit position regulation parts 21*a* and 21*a*, referred to hereinafter, of the white key 3*a* are engaged with the respective engagement holes 11*b* and 11*b* in a state inserted therethrough.

The chassis center 12 serves to guide the black keys 3*b*. Similarly to the chassis front 11, the chassis center 12 has a plurality of black key guide parts 12*a* (only five of which are shown in FIG. 3A) erected thereon and each inserted into an associated one of the black keys 3*b* from below so as to prevent lateral swing of the black key 3*b*. Further, at a location forward of the chassis center 12, there is disposed a hammer support part 15 for supporting hammers 4. The hammer support part 15 has a plurality of support shafts 15*a* extending along a single straight line extending in the left-right direction, and the hammers 4 are pivotally supported by the support shafts 15*a*, respectively.

Further, between the hammer support part 15 and the chassis front 11, there is mounted the key switch 5. The key switch 5 is comprised of a laterally elongated printed circuit board 5*a* extending in the left-right direction, and a plurality of switch bodies 5*b* each formed by a rubber switch and mounted on the printed circuit board 5*a* in association with each key 3.

Figure 3B:
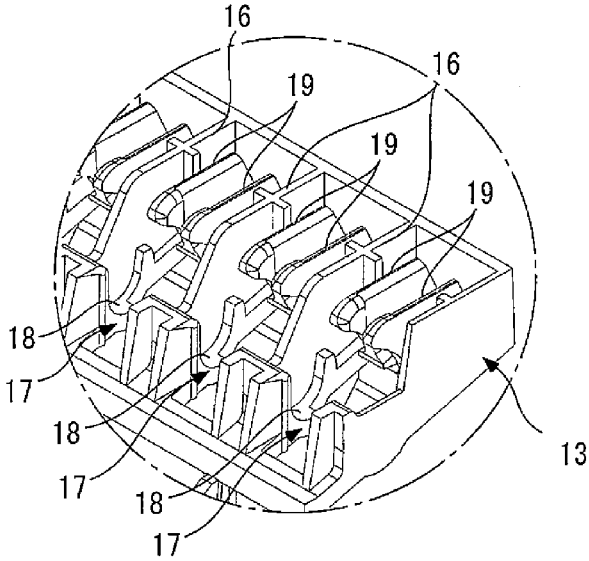
FIG. 3B is an enlarged perspective view of a portion, encircled in FIG. 3A, of a rear end of the keyboard chassis.

The chassis rear 13 serves to support the keys 3 by their rear ends such that the keys 3 can pivotally move in the vertical direction. As shown in FIG. 3B, the chassis rear 13 is provided with a plurality of partition walls 16 which are formed with a predetermined spacing therebetween in the left-right direction such that adjacent keys 3 and 3 are separated from each other. Further, between each pair of adjacent ones of the partition walls 16, there is formed a predetermined key support part 17 having a laterally symmetrical shape and configured to pivotally support an associated one of the keys 3. Specifically, the key support part 17 has left and right lower support portions 18 and 18 (only the left one of which is shown in FIG. 3B) for supporting, from below, respective left and right pivot shafts 24 and 24, referred to hereinafter, and a pair of left and right upper support portions 19 and 19 for supporting, from above, a portion of a rear end of the key 3 extending from the upper surface of the key 3 to the rear surface thereof.

Figure 4:
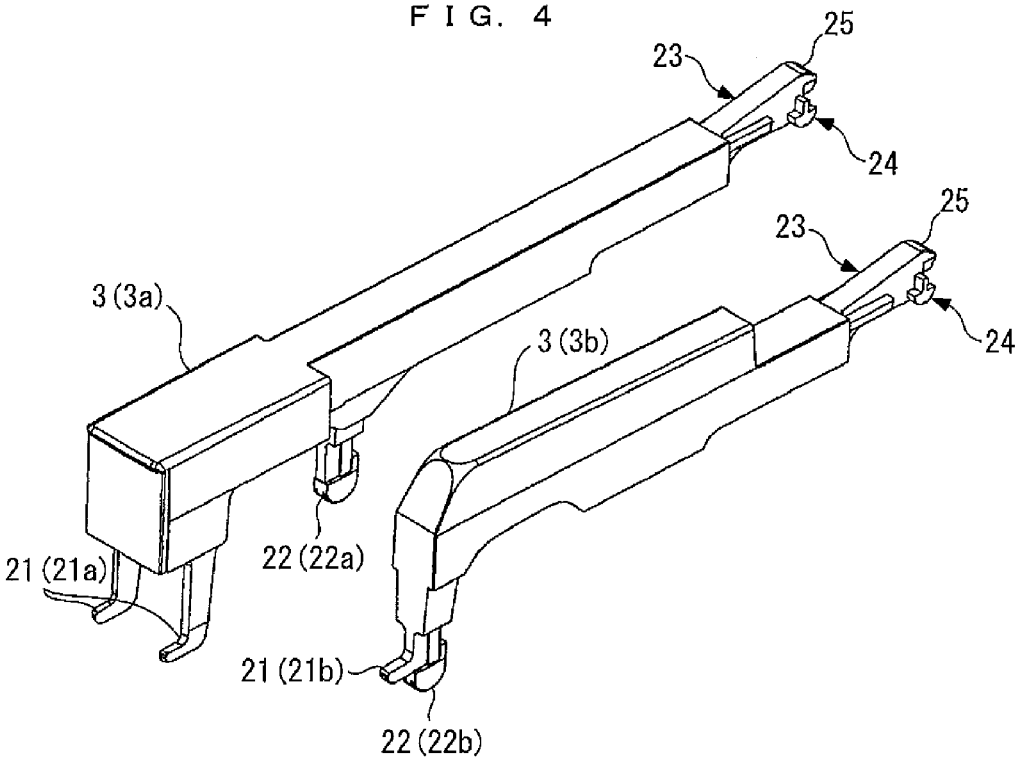
FIG. 4 is a perspective view of a white key and a black key.

The key 3 is formed e.g. by injection molding of a predetermined resin material (e.g. an AS resin) into a hollow shape which extends over a predetermined length in the front-rear direction and opens downward. As shown in FIGS. 3A and 4, the white key 3*a* has a front end thereof formed with the pair of left and right upper limit position regulation parts 21 (21*a*) which extend downward from respective side walls of the front end of the white key 3*a* and each having a lower end thereof bent forward. The upper limit position regulation parts 21 (21*a*) are engaged with the respective left and right engagement holes 11*b* and 11*b* of the chassis front 11 in a state inserted therethrough. Further, the white key 3*a* has an actuator part 22 (22*a*), which projects downward, formed at a predetermined location rearward of the upper limit position regulation parts 21*a*. The actuator part 22*a* is engaged with an engagement recess 34, referred to hereinafter, of the hammer 4 in a state received therein. On the other hand, the black key 3*b* has a front end thereof formed with an upper limit position regulation part 21 (21*b*) and an actuator part 22 (22*b*), which respectively have the same functions as the function of each of the upper limit position regulation parts 21*a* and that of the actuator part 22*a* of the white key 3*a*.

Figure 5A:
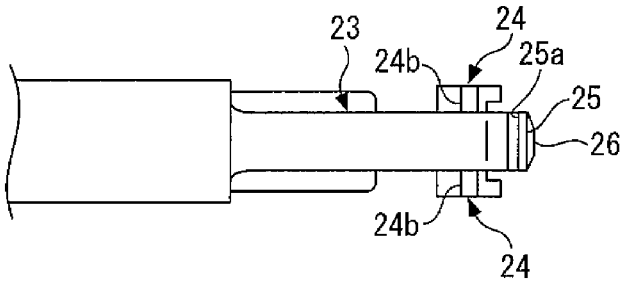
FIG. 5A is an enlarged plan view of a rear portion of a key.
Figure 5B:
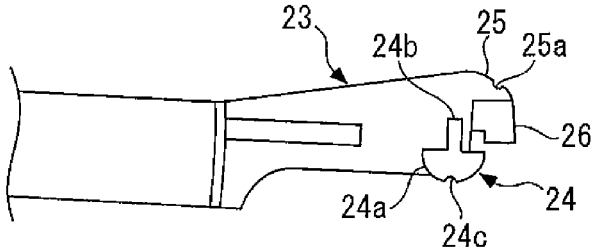
FIG. 5B is an enlarged left side view of the rear portion of the key.

As shown in FIGS. 4, 5A, and 5B, the key 3 has a rear part including a rear body 23 formed such that it has a smaller width than that of part of the key 3 forward thereof and extends in the front-rear direction. The pivot shafts 24 and 24, which protrude outward (i.e. leftward and rightward, respectively), are formed on the left and right side surfaces of the rear body 23 at respective predetermined locations close to an extreme rear end of the rear body 23. Each of the pivot shafts 24 and 24 has a lower half formed as a semicircular portion 24*a* having an arcuate bottom surface and a semicircular side surface, and a protrusion 24*b* protruding upward from the center of the semicircular portion 24*a* in the front-rear direction. Note that the semicircular portion 24*a* of each of the pivot shafts 24 has a groove 24*c* formed in the arcuate bottom surface thereof, such that when a lubricant, such as a grease, is applied to the arcuate bottom surface of the semicircular portion 24*a*, the grease can be held therein for a long time.

The rear body 23 has a rear end thereof formed with a curved surface 25 extending from the upper surface of the rear body 23 to the rear surface thereof with a predetermined curvature. The curved surface 25 is formed to be convexly curved along a concentric circle about the pivot shaft 24 of the key 3 in side view. Further, the rear end of the rear body 23 has a tapered portion 26 continuous with the curved surface 25 and having a lateral width progressively reduced downward. Note that the curved surface 25 is formed with a groove 25*a* having the same function as that of the groove 24*c* of the pivot shaft 24.

Figure 6A:
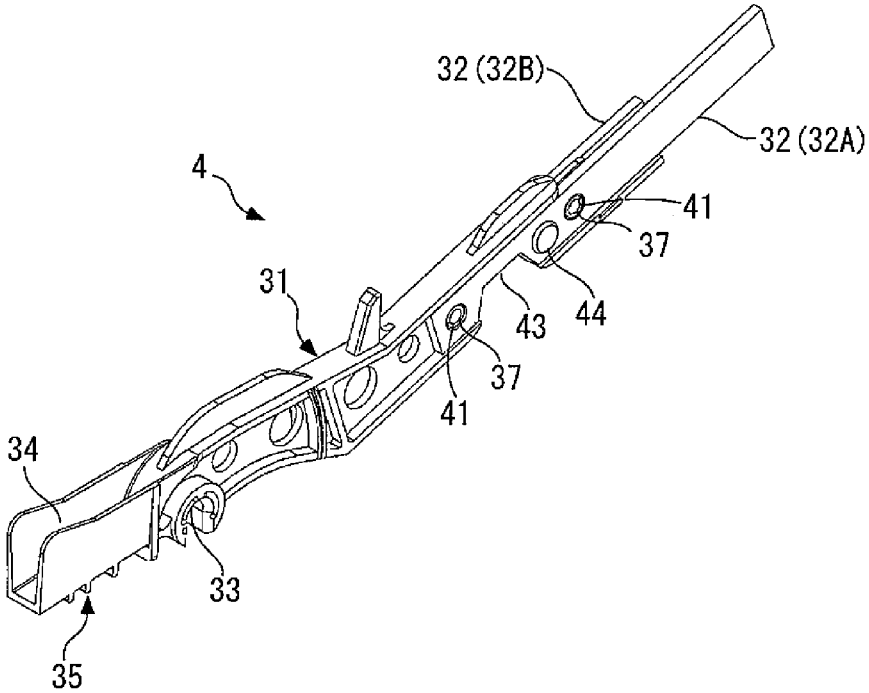
FIG. 6A is a perspective view of the appearance of a hammer.
Figure 6B:
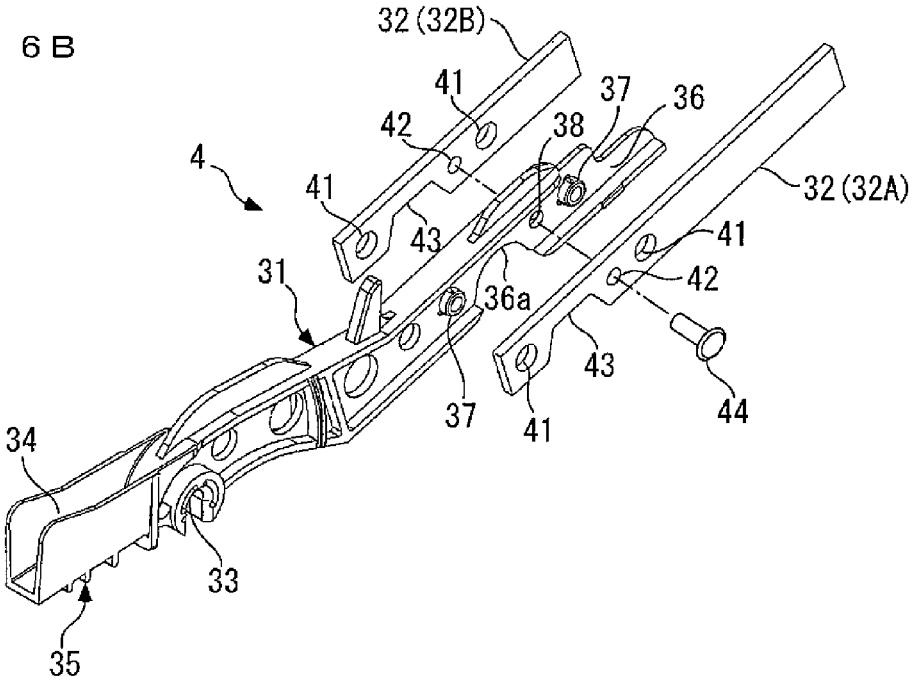
FIG. 6B is an exploded perspective view of the hammer disassembled into a hammer body and weights.

As shown in FIGS. 6A and 6B, the hammer 4 is comprised of a hammer body 31 and two weights 32 and 32 attached to the hammer body 31. The hammer body 31 is formed as a resin molded article which is made e.g. by injection molding of a predetermined resin material (e.g. POM (polyacetal resin)) into a predetermined shape. The hammer body 31 extends over a predetermined length in the front-rear direction and has a bearing portion 33 formed at a predetermined location forward of the center of the hammer body 31 in the front-rear direction. The bearing portion 33 has an inverted U shape opening downward in side view and is pivotally engaged with the support shaft 15*a* of the hammer support part 15 of the keyboard chassis 2. The engagement recess 34 for engagement with the actuator part 22 of the key 3 is formed in the front half of the hammer body 31 at a location forward of the bearing portion 33. The engagement recess 34 is open upward and forward, and the lower portion of the actuator part 22 of the key 3 is received in the engagement recess 34 in a state in which a lower end of the actuator part 22 is held in contact with a bottom surface of the engagement recess 34. Further, formed below the engagement recess 34 in the front half of the hammer body 31 are a plurality of switch pressing portions 35 for pressing the switch body 5*b* of the key switch 5.

A weight mounting part 36 as a rear half of the hammer body 31 has two, i.e. front and rear, pairs of engagement protrusions 37 and 37 formed on the respective left and right side surfaces of the weight mounting part 36 at predetermined locations, in a manner protruding outward, i.e. leftward and rightward, respectively, from the weight mounting part 36, and a mounting hole 38 formed at a location close to the rear pair of engagement protrusions 37, in a manner extending through the weight mounting part 36 in the left-right direction. Note that a cutout 36*a* is formed in a central portion of the weight mounting part 36 so as to prevent screws and the like that fix the keyboard device 1 to the keybed 10 of an electronic piano (see FIG. 2B) from coming into abutment with the hammer 4 when the keyboard device 1 is in the key-released state.

The weights 32 are made of a material (metal such as steel) larger in specific gravity than the hammer body 31, and are formed as two long and narrow plates. Each of the weight 32 is formed into a predetermined shape by pressing a long metal plate having a predetermined thickness and width. Specifically, the weight 32 is formed with two, i.e. front and rear, engagement holes 41 and 41, a mounting hole 42, and a recess 43, which correspond, respectively, to the two engagement protrusions 37 and 37, the mounting hole 38, and the cutout 36*a* formed in the hammer body 31. The two weights 32 and 32 are rigidly secured to the hammer body 31 in a state sandwiching the weight mounting part 36 of the hammer body 31, by riveting rivets 44 inserted through the mounting holes 42, 42, and 38.

One of the weights attached to each of the hammers 4 (hereinafter referred to as "the common weight 32A") has a predetermined length and is common to all the hammers 4. On the other hand, the other weight (hereinafter referred to as "the adjustment weight 32B") is formed to have a length equal to or smaller than that of the common weight 32A. Therefore, it is possible to change the weight of the hammer 4 including the two weights 32A and 32B by adjusting the length of the adjustment weight 32B.

In the keyboard device 1 constructed as above, when the key 3 is depressed in the key-released state shown in FIGS. 1 and 2B, the key 3 pivotally moves downward about the left and right pivot shafts 24 and 24 of the rear end of the key 3. In accordance with this pivotal motion of the key 3, the actuator part 22 of the key 3 presses the engagement recess 34 of the hammer 4 downward. As a consequence, the hammer 4 presses the associated switch bodies 5*b* of the key switch 5 from above by the switch pressing portions 35 while pivotally moving in the counterclockwise direction, as viewed in FIG. 2B, about the support shaft 15*a* of the hammer support part 15. In this case, the rear end of the hammer 4 (i.e. the rear end of the common weight 32A) is brought into abutment with a hammer stopper 13*a* of the chassis rear 13 from below, whereby further pivotal motion of the hammer 4 is inhibited. By the key depressing operation described above, a predetermined touch weight corresponding to the weight and torque of the hammer 4 is imparted to the key 3, and key depression information on the key 3 is detected via the key switch 5 at the same time.

On the other hand, when the depressed key 3 is released, the hammer 4 pivotally moves in the clockwise direction as viewed in FIG. 2B. In accordance with this pivotal motion of the hammer 4, the key 3 is pushed upward via the actuator part 22 and pivotally moves upward. As a consequence, each of the key 3 and the hammer 4 returns to its key-released state as shown in FIGS. 1 and 2B. In this case, the upper limit position regulation parts 21 of the front end of the key 3 are brought into abutment with a predetermined stopper 20 of the keyboard chassis 2 from below, whereby further pivotal motion of the key 3 is inhibited.

Figure 7A:
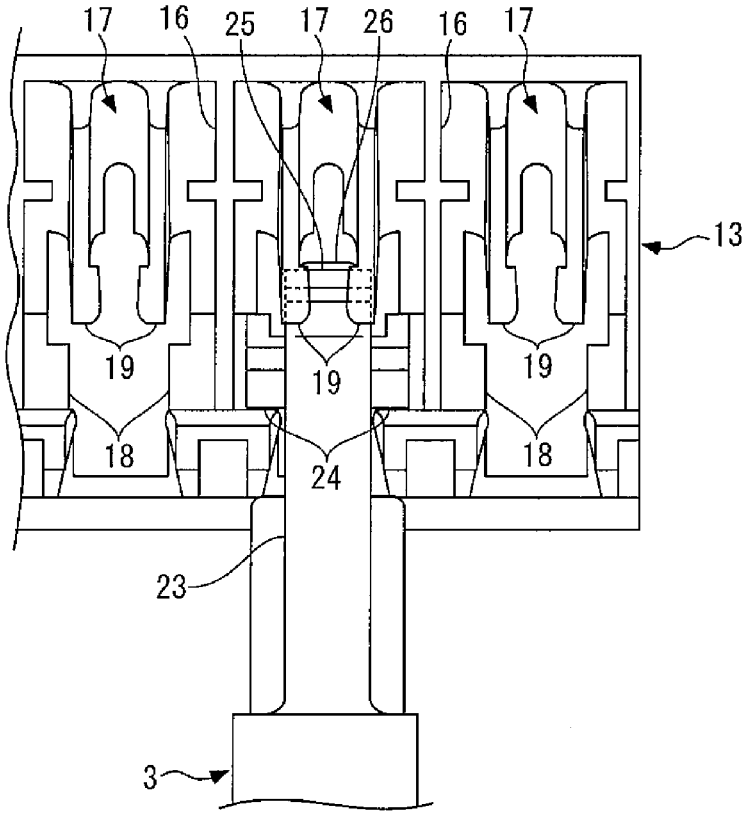
Figure 7B:
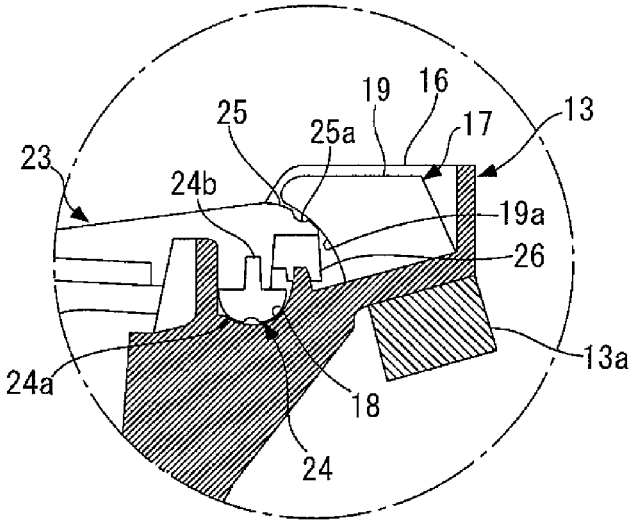

Next, a further detailed description will be given of the keyboard device 1 according to the present invention, focusing on a pivotal motion support structure of the key 3 constituted by the key support parts 17 of the keyboard chassis 2. FIGS. 7A and 7B show the chassis rear 13 of the keyboard chassis 2 and the rear end of a key 3. As shown in FIGS. 7A and 7B, in the chassis rear 13, the pair of left and right upper support portions 19 and 19 of each of the key support parts 17 are erected with a spacing therebetween which is smaller than the lateral width of the rear body 23 of the key 3. Each of the upper support portions 19 has a front surface thereof formed with a support surface 19*a* concavely curved along a concentric circle about the pivot shaft 24 of the key 3. On the other hand, the key 3 has the curved surface 25 at the rear end of the rear body 23, as described hereinbefore. The curved surface 25 (sliding-contact surface) is convexly curved along a concentric circle about the pivot shaft 24 of the key 3 and is in sliding contact with the support surface 19*a* of each of the upper support portions 19 of the key support part 17.

Further, the left and right lower support portions 18 and 18 of the key support part 17 support the respective left and right pivot shafts 24 and 24 of the key 3 from below, and the left and right upper support portions 19 and 19 of the key support part 17 support the respective left and right peripheral portions of the curved surface 25 of the key 3 from above via the support surfaces 19*a* and 19*a* of the respective upper support portions 19 and 19. Thus, when the key 3 is depressed, the key 3 performs stable pivotal motion about the pivot shafts 24 and 24.

When mounting the key 3 to the key support part 17 of the keyboard chassis 2, the rear end (tapered portion 26) of the key 3 is pressed from above such that it is inserted between the left and right upper support portions 19 and 19. As a consequence, the upper support portions 19 and 19 are pushed outward, i.e. leftward and rightward, respectively, to be elastically deformed and thereby allow the rear end of the key 3 to pass downward therebetween. After the rear end of the key 3 has thus passed downward, the two upper support portions 19 and 19 elastically return to their original state and cooperate with the left and right lower support portions 18 and 18 to hold the rear end of the key 3 in a retained state.

As described above, according to the present embodiment, the rear end of the key 3 is pivotally supported by the key support part 17 having the lower support portions 18 and 18 and the upper support portions 19 and 19, so that it is possible to ensure stabile pivotal motion of the key 3 about the pivot shafts 24 and 24. Further, differently from the prior art, the key 3 is not elastically deformed during mounting of the key 3 to the keyboard chassis 2, and therefore the key 3 can be easily mounted on the keyboard chassis 2 without being damaged.

Note that the present invention is by no means limited to the embodiment described above, but it can be practiced in various forms. For example, although in the present embodiment, the left and right pivot shafts 24 and 24 of the rear end of the key 3 are formed in a manner protruding from the respective left and right side surfaces of the rear body 23, it is possible to employ a single pivot shaft extending in the left-right direction.

It is further understood by those skilled in the art that the foregoing is a preferred embodiment of the invention, and that various changes and modifications may be made without departing from the spirit and scope thereof.

What is claimed is:

1. A keyboard device for a keyboard instrument, comprising:

a plurality of keys each extending in a front-rear direction and having a pivot shaft extending from a rear end of said key in a left-right direction; and a keyboard chassis having a plurality of key support parts for supporting said keys, respectively, such that each of said keys can pivotally move about an associated one of said pivot shafts, and configured to hold said keys in a state arranged in the left-right direction, wherein each of said key support parts includes:

a lower support portion for supporting said pivot shaft of an associated one of said keys from below, and a pair of left and right upper support portions erected with a predetermined spacing therebetween in the left-right direction, and configured to support a portion of said rear end of said key located upward of said pivot shaft from above, and wherein when mounting said key to said key support part, spacing between said pair of upper support portions is expanded by said rear end of said key, whereby said pair of upper support portions are elastically deformed to thereby allow said rear end of said key to pass therebetween, and after said rear end of said key has passed, said pair of upper support portions elastically return to an original state thereof and cooperate with said lower support portion to hold said rear end of said key in a retained state.

2. The keyboard device according to claim 1, wherein each of said pair of upper support portions has a support surface formed to be concavely curved along a concentric circle about said pivot shaft of an associated one of said keys, and said rear end of said key has a sliding surface formed to be convexly curved along a concentric circle about said pivot shaft and be brought into sliding contact with the support surface.

* * * * *